US005278128A

United States Patent [19]

Hotta et al.

[11] Patent Number: 5,278,128

[45] Date of Patent: Jan. 11, 1994

[54] REVERSIBLE THERMOSENSITIVE RECORDING MATERIAL

[75] Inventors: Yoshihiko Hotta, Mishima; Atsushi Kutami, Numazu; Makoto Kawaguchi, Shizuoka; Tetsuya Amano, Numazu, all of Japan

[73] Assignee: Ricoh Company, Ltd., Tokyo, Japan

[21] Appl. No.: 29,043

[22] Filed: Mar. 10, 1993

[30] Foreign Application Priority Data

Mar. 11, 1992 [JP] Japan ..... 4-087817
Feb. 19, 1993 [JP] Japan ..... 5-054827

[51] Int. Cl.[5] ..... B41M 5/26

[52] U.S. Cl. ..... 503/207; 503/200; 503/201; 503/226; 503/217; 503/208

[58] Field of Search ..... 503/200, 201, 207, 208, 503/217, 226

[56] References Cited

U.S. PATENT DOCUMENTS 5,087,601 2/1992 Hotta et al. ..... 503/208

*Primary Examiner*—Pamela R. Schwartz
*Attorney, Agent, or Firm*—Oblon, Spivak, McClelland, Maier & Neustadt

[57] ABSTRACT

A reversible thermosensitive recording material composed of a support, an undercoat layer formed on the support, and a reversible thermosensitive recording layer formed on the undercoat layer, capable of reversibly assuming a transparent state and a white opaque state depending on the temperature thereof, the undercoat layer having at least one colored portion and at least one light reflecting portion.

10 Claims, 3 Drawing Sheets

REVERSIBLE THERMOSENSITIVE RECORDING MATERIAL

BACKGROUND OF THE INVENTION

1. Field of the Invention

The present invention relates to a reversible thermosensitive recording material capable of recording and erasing images repeatedly by utilizing the property of reversibly changing the transparency from a transparent state to an opaque state depending upon the temperature thereof.

2. Discussion of Background

Recently attention has been paid to a reversible thermosensitive recording material capable of temporarily recording images thereon and erasing the same therefrom when such images become unnecessary. For example, as disclosed in Japanese Laid-Open Patent Applications 54-119377 and 55-154198, there are conventionally known reversible thermosensitive recording materials in which an organic low-molecular-weight material such as a higher fatty acid is dispersed in matrix resin such as a vinyl chloride resin. These according materials reversibly assume a transparent state and a white opaque state, so that an image formed in the recording materials can usually be recognized as a reflected one by providing a colored material on the reverse side of the recording material. However, the image contrast is insufficient merely by providing the colored material on the reverse side of the recording material. Therefore, the formation of a light reflection layer on the reverse side of the recording material is proposed, as disclosed in Japanese Laid-Open Patent Application 1-14079. However, in the case where the light reflection layer is provided on the reverse side of the recording material, images are not always legible depending on the light reflection directions when the images are seen with the naked eyes even though the contrast is remarkably improved in terms of the density and the reflectance thereof measured by a measuring instrument such as a reflection-type densitometer.

When a colored material is provided on the reverse side of the recording material, there is the shortcoming that the image contrast measured by the aforementioned measuring instrument is degraded although images can visually be recognized to some extent regardless of the light reflection directions.

SUMMARY OF THE INVENTION

It is therefore an object of the present invention to provide a reversible thermosensitive recording material capable of producing images thereon which can be seen with the naked eyes with no difficulty, and at the same time, which can show high contrast when measured by a measuring instrument.

This object of the present invention can be achieved by a reversible thermosensitive recording material comprising a support, an undercoat layer formed on the support, and a reversible thermosensitive recording layer formed on the undercoat layer, capable of reversibly assuming a transparent state and a white opaque state depending on the temperature thereof, the undercoat layer comprising at least one colored portion and at least one light reflecting portion.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 1(*g*) is a plan view of a reversible thermo-sensitive recording material of the present invention, which is used as a display medium;

DETAILED DESCRIPTION OF THE PREFERRED EMBODIMENTS

The present invention will now be explained in detail by referring to the figures.

Figure 1:
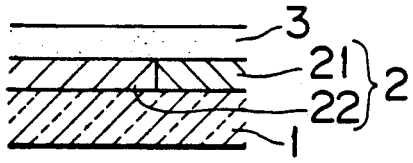
FIGS. 1(*a*) through 1(*f*) are schematic partial cross-sectional views showing six embodiments of a reversible thermosensitive recording material of the present invention.
Figure 1:
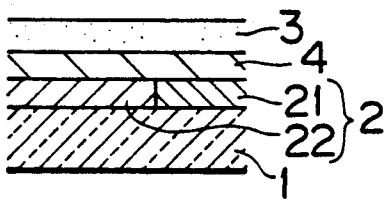
Figure 1:
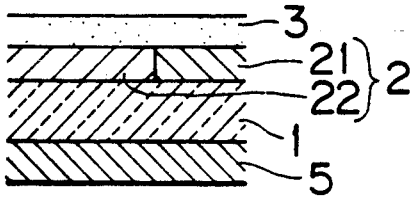
Figure 1:
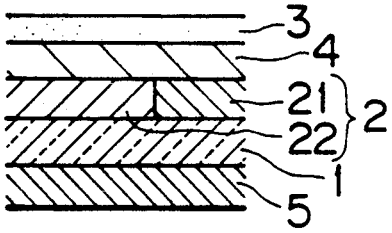
Figure 1:
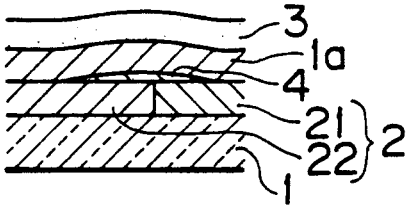
Figure 1:
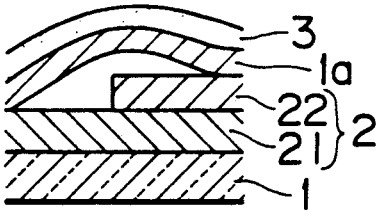
Figure 1:
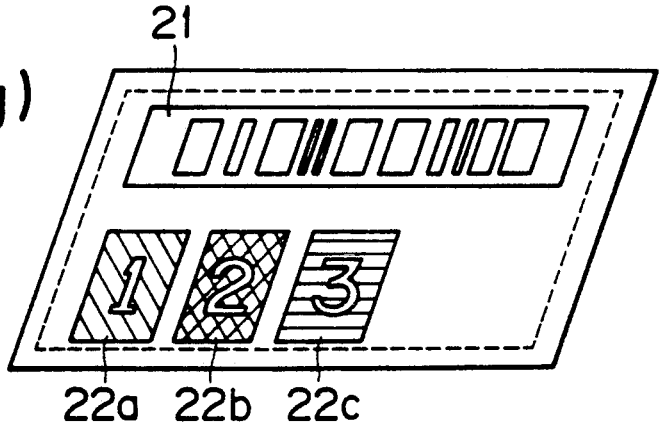

FIGS. 1(*a*) through 1(*f*) are schematic partial cross-sectional views showing six embodiments of a reversible thermosensitive recording material of the present invention.

In FIG. 1(*a*), a reversible thermosensitive recording material comprises a support 1, an undercoat layer 2 comprising a light reflecting portion 21 and a colored portion 22 which are arranged side by side on the support 1, and a reversible thermosensitive recording layer 3 formed on the undercoat layer 2.

In FIG. 1(*b*), a reversible thermosensitive recording material comprises a support 1, and an undercoat layer 2 comprising a light reflecting portion 21 and a colored portion 22, a low-refractive-index layer 4 and a reversible thermosensitive recording layer 3 which are successively overlaid on the support 1.

A reversible thermosensitive recording material shown in FIG. 1(*c*) has the same structure as in FIG. 1(*a*) except that a magnetic recording layer is provided on the back side of the support 1, opposite to the undercoat layer 2 with respect to the support 1.

A reversible thermosensitive recording material shown in FIG. 1(*d*) has the same structure as in FIG. 1(*b*) except that a magnetic recording layer 5 is provided on the back side of the support 1, opposite to the undercoat layer 2 with respect to the support 1.

In FIG. 1(*e*), a reversible thermosensitive recording material comprises a support 1, an undercoat layer 2 comprising a light reflecting portion 21 and a colored portion 22 formed on the support 1, a low-refractive-index layer 4 partially formed on the undercoat layer 2, a transparent support la formed on the low-refractive-index layer 4, and a reversible thermosensitive recording layer 3 formed on the transparent support 1*a*.

A reversible thermosensitive recording material shown in FIG. 1(*f*) comprises a support 1, a light reflecting portion 21 entirely formed on the support 1, a colored portion 22 partially formed on the light reflecting portion 21, which two portions constitute an undercoat layer 2, a low-refractive-index layer 4, which is an air-containing vacant portion, formed on the colored portion 22, a transparent support 1*a* formed on the low-refractive-index layer 4, and a reversible thermosensitive recording layer 3 formed on the transparent support 1a.

As previously mentioned, the undercoat layer 2 in the recording material of the present invention comprises at least one light reflecting portion 21 and one colored portion 22. These portions 21 and 22 in the undercoat layer 2 for use in the present invention can be prepared by printing or coating with a mixture of a resin and a dye or pigment capable of producing a color of black, blue, red, green, gold or silver. In addition to the above, evaporation of metals such as Al, Au, Ag, Sn and Zn or application of a foil of the above metals is possible. The undercoat layer 2 for use in the present invention can be thus prepared in combination with a plurality of the above-mentioned light reflecting and colored portions.

Further, it is preferable that the colored portion 22 comprise at least two areas having different absorption bands. Thus, images can be formed on the background of different colors, so that visual recognition of the images can be facilitated.

Moreover, it is preferable that the glossiness of the light reflecting portion 21 of the undercoat layer 2 being 200% or more, more preferably 300% or more, and further preferably 500% or more measured at an angle of 60° in accordance with ASTM D523.

In the undercoat layer 2, it is preferable that the light reflecting portion 21 comprise at least two areas having different reflectance.

Figure 2:
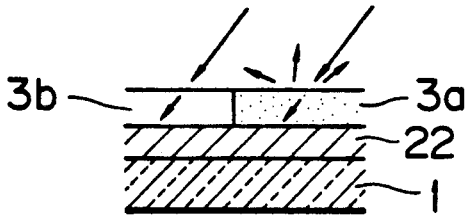
FIGS. 2(*a*) through 2(*c*) are schematic partial cross-sectional views in explanation of the effects of a reversible thermosensitive recording material of the present invention.
Figure 2:
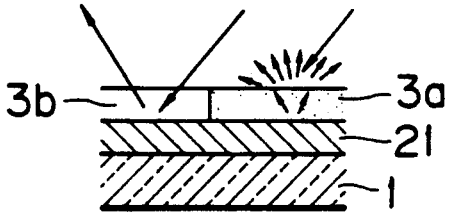
Figure 2:
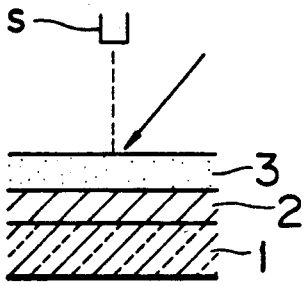

FIGS. 2(a) through 2(c) are schematic partial cross-sectional views in explanation of the effects of the reversible thermosensitive recording material of the present invention, which comprises an undercoat layer 2 comprising at least a light reflecting portion 21 and a colored portion 22.

In the reversible thermosensitive recording material shown in FIG. 2(a), a white opaque portion 3a and a transparent portion 3b formed in a reversible thermosensitive recording layer 3 are provided on the colored portion 22 in the undercoat layer 2. The light entering the white opaque portion 3a is scattered therein. The light scattered from the surface of the white opaque portion 3a is diffused in all directions. On the other hand, the light entering the transparent portion 3b passes therethrough, and is absorbed in the colored portion 22. The light is not reflected from the surface of the transparent portion 3b. Namely, when the reversible thermosensitive recording layer 3 shown in FIG. 2(a) is seen with the naked eyes, the white opaque portion 3a appears white opaque, and a color of the colored portion 22 can be seen at the transparent portion 3b in the recording layer 3. This tendency is almost the same even when the recording layer 3 is seen with the naked eyes from any angle.

When the image density of the recording material is measured by a reflection-type densitometer or the obtained image is read by a bar code reader, a photosensor (s) may usually be set vertically to the surface of the recording layer 3 as shown in FIG. 2(c). The light is caused to enter the recording layer 3 from an oblique angle and the amount of light reflected from the recording layer 3 is measured by the photosensor (s).

In FIG. 2(a), a part of the light entering the white opaque portion 3a in the reversible thermosensitive recording layer 3 passes therethrough and is absorbed into the colored portion 22. Therefore, the amount of light scattered from the surface of the white opaque portion 3a is decreased, so that the total amount of light measured by the photosensor (s) is decreased. As a result, the image contrast between the transparent portion 3b and the white opaque portion 3a is lowered.

In the reversible thermosensitive recording material shown in FIG. 2(b), a white opaque portion 3a and a transparent portion 3b formed in the reversible thermosensitive recording layer 3 are provided on a light reflecting portion 21 in the undercoat layer 2. The light entering the white opaque portion 3a passes therethrough, and is reflected from the light reflecting portion 21. Therefore, the amount of light scattered from the white opaque portion 3a is increased as a whole. On the other hand, the light entering the transparent portion 3b passes therethrough, and is all reflected from the light reflecting portion 21, so that no light is received by the photosensor (s). As a result, high image contrast between the transparent portion 3b and the white opaque portion 3a in the recording layer 3 can be obtained when measured by a measuring instrument.

However, when the reversible thermosensitive recording layer 3 shown in FIG. 2(b) is seen with the naked eyes, the whiteness degree in the white opaque portion 3a seems to be improved. However, the transparent portion 3b in the recording layer 3 is very illegible when it is seen from the angle in which the light is reflected although there is no problem when the transparent portion 3b is seen at the position where no light is reflected.

The undercoat layer 2 for use in the present invention comprises at least one colored portion 22 and at least one light reflecting portion 21. The colored portion 22 in the undercoat layer 2 is utilized when the reversible thermosensitive recording material of the present invention is seen with the naked eyes, and the light reflecting portion 21 in the undercoat layer 2 is utilized to read the obtained image such as a bar code in the recording material by a reading apparatus such as a bar code reader. Consequently, in the reversible thermosensitive recording material of the present invention, not only the images can be visually recognized without any problems, but also the contrast of the images can be increased measured by the apparatus.

FIG. 1(g) is a plan view of the reversible thermo-sensitive recording material of the present invention, which is used as a display medium. This recording material has the same structure as shown in FIG. 1(e), and the undercoat layer 2 comprises colored portions 22a, 22b and 22c and a light reflecting portion 21. In this display medium, white opaque images (numerals) are formed on the reversible thermosensitive recording layer corresponding to the colored portions 22a, 22b and 22c with different colors in the undercoat layer, while bar code images are recorded on the recording layer corresponding to the light reflecting portion 21 in the undercoat layer.

The bar code formed in the recording material of the present invention may recognize the optical change such as a change in light intensity or wavelength as the information even though the employed light is within the wave range of visible light or not. For example, an optical recognition pattern display such as two-dimensional bar code, OCR, or calra code is included.

The reversible thermosensitive recording material of the present invention may comprise a low-refractive-index layer 4, which is interposed between the undercoat layer 2 and the reversible thermosensitive recording layer 3, as shown in FIGS. 1(b), 1(d), 1(e) and 1(f). By the provision of the low-refractive-index layer 4, after the light passes through the white opaque portion 3a in the reversible thermosensitive recording layer 3, a large amount of light can be reflected by the interface between the recording layer 3 and the low-refractive-index layer 4, so that the contrast of image formed in the recording material can be further improved.

For the low-refractive-index layer 4, any resins with a refractive index lower than that of the material for use in the thermosensitive recording layer 3 can be employed. It is preferable that the low-refractive-index layer 4 have a refractive index of 1.5 or less, more preferably 1.4 or less in accordance with ASTM D542. Examples of the resin for use in the low-refractive-index layer 4 are polypropylene (refractive index: 1.49), poly-4-methylpentene-1, (refractive index: 1.465), methacrylic resin (refractive index: 1.49), ethylene tetrafluoride resin (refractive index: 1.35), vinylidene fluoride resin (refractive index: 1.42), polyacetal (refractive index: 1.48), and cellulose acetate (refractive index: 1.46–1.50). In addition to the above resins, water (refractive index: 1.33) and air (refractive index: 1.0) can be used for the low-refractive-index layer 4.

Moreover, the reversible thermosensitive recording material may further comprise a magnetic recording layer 5. By the provision of the magnetic recording layer 5, a part of information which is magnetically recorded in the magnetic recording layer 5 can be displayed on the thermosensitive recording layer 3, so that the reversible thermosensitive recording material of the present invention becomes convenient.

The magnetic recording layer 5 may be provided on the back side of the support 1, opposite to the undercoat layer 2 with respect to the support 1 as shown in FIG. 1(c) and FIG. 1(d), or between the undercoat layer 2 and the support 1. The magnetic recording layer 5 may serve as the undercoat layer.

For the preparation of the magnetic recording layer 5, conventionally used iron oxide and barium ferrite are used with resins.

When the reversible thermosensitive recording material is used for the display medium, the obtained display medium may further comprise an information memory function by use of IC, optical memory and magneto-optical memory. A part of the information recorded by using the above function can be displayed on the thermosensitive recording layer 3 when necessary.

A plastic film such as a PET film, polyvinyl chrolide film, or polyacetate film is usually employed as the support 1. In such a plastic film, a pigment, especially a white pigment, may be dispersed.

The same plastic film as used for the support 1 can be employed as the transparent support la as shown in FIGS. 1(e) and 1(f). It is preferable that the light transmittance of the transparent support la be 50% or more, more preferably 70% or more, and further preferably 80% or more.

It is preferable that the thickness of the support 1 be in the range of about 0.1 to 5 mm, more preferably in the range of 0.15 to 1 mm. The thickness of the transparent support la is preferably in the range of about 20 to 500 μm, more preferably in the range of 30 to 200 μm.

The thickness of the undercoat layer 2 is preferably in the range of about 100 Å to 10 μm, more preferably 200 Å to 5 μm.

Further, the materials for use in the reversible thermosensitive recording layer 3 in the present invention will now be explained. Any materials capable of reversibly changing the transparency depending on the temperature thereof can be used for the preparation of the reversible thermosensitive recording layer 3 in the present invention. In particular, the material with the property of reversibly assuming a transparent state and a white opaque state depending on the temperature thereof is appropriate for the reversible thermosensitive recording layer 3. The reversible thermosensitive recording layer 3 comprises a matrix resin and an organic low-molecular-weight material dispersed in the matrix resin.

In the reversible thermosensitive recording material of the present invention, the property of changing the transparency from a transparent state to a white opaque state depending on the temperature thereof is utilized. Thc difference between the transparent state and the white opaque state of the reversible thermosensitive recording layer 3 is considered to be based on the following principle:

(i) In the transparent state, the organic low-molecular-weight material dispersed in the matrix resin consists of relatively large crystals, so that the light which enters the crystals from one side passes therethrough to the opposite side, without being scattered, thus the reversible thermosensitive recording material appears transparent.

(ii) In the milky white opaque state, the organic low-molecular-weight material is composed of polycrystals consisting of numerous small crystals, with the crystallographic axis pointed to various directions, so that the light which enters the recording layer 3 is scattered a number of times at the interfaces of the crystals of the organic low-molecular-weight material. As a result, the thermosensitive recording layer 3 becomes opaque in a milky white color.

The transition of the state of the reversible thermosensitive recording layer 3 depending on the temperature thereof will now be explained by referring to FIG. 3.

Figure 3:
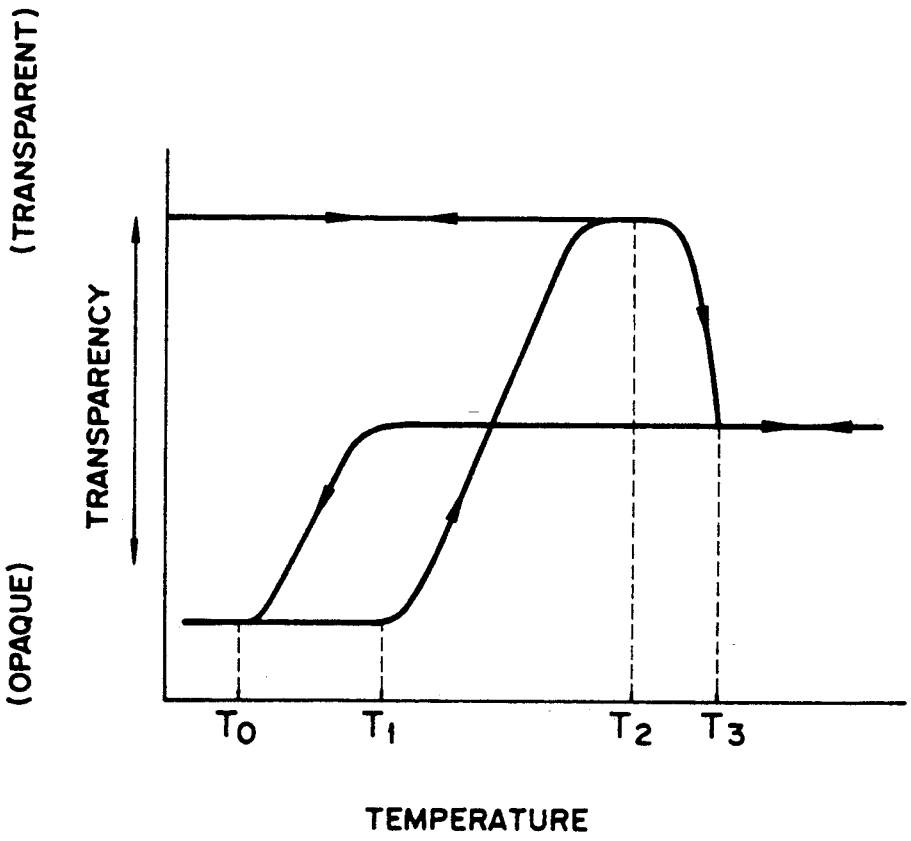
FIG. 3 is a diagram in explanation of the principle of formation and erasure of images in a reversible thermosensitive recording material of the present invention.

In FIG. 3, it is supposed that the reversible thermosensitive recording layer comprising a matrix resin and an organic low-molecular-weight material dispersed in the matrix resin is initially in a milky white opaque state at room temperature $T_0$ or below. When the thermosensitive recording layer is heated to temperature $T_2$, the thermosensitive recording layer becomes transparent. Thus, the recording layer reaches a maximum transparent state at temperature $T_2$. Even if the recording layer which is already in the maximum transparent state is cooled to room temperature $T_0$ or below, the maximum transparent state is maintained. It is considered that this is because the organic low-molecular-weight material changes its state from a polycrystalline state to a single crystalline state via a semi-melted state during the above-mentioned heating and cooling steps.

When the recording layer in the maximum transparent state is further heated to temperature $T_3$ or more, it assumes a medium state which is between the maximum transparent state and the maximum milky white opaque state. When the recording layer in the medium state at temperature $T_3$ or more is cooled to room temperature $T_0$ or below, the recording layer returns to the original maximum opaque state, without passing through any transparent state. It is considered that this is because the organic low-molecular-weight material is melted when heated to temperature $T_3$ or above, and the polycrystals of the organic low-molecular-weight material grow and separate out when it is cooled. If the recording layer in the milky white opaque state is heated to any temperature between temperature $T_1$ and temperature $T_2$, and then cooled to room temperature $T_0$ or below, the recording layer assumes an intermediate state between the transparent state and the milky white opaque state.

When the recording layer in the transparent state at room temperature $T_0$ is again heated to temperature $T_3$ or above, and then cooled to room temperature $T_0$, the recording layer returns to the milky white opaque state. Thus, the reversible thermosensitive recording layer for use in the present invention can assume a milky white opaque state, a transparent state and an intermediate state between the aforementioned two states at room temperature.

Therefore, a milky white opaque image can be obtained on a transparent background, or a transparent image can also be obtained on a milky white opaque background by selectively applying the thermal energy to the reversible thermosensitive recording layer for use in the present invention. Further, such image formation and erasure can be repeated many times.

It is preferable that the average particle diameter of the organic low-molecular-weight material dispersed in the reversible thermosensitive recording layer 3 be in the range of 0.1 to 2.0 μm in order to obtain the contrast sufficient to read an image such as a bar code image formed in the reversible thermosensitive recording layer 3. When the size of the organic low-molecular-weight material is within the above range, the whiteness degree in the milky white opaque state is appropriate.

As previously mentioned, the process of recording images in the reversible thermosensitive recording material of the present invention and erasing the same therefrom is based on the light scattering and light transmission caused by the change of the crystalline states of the organic low-molecular-weight material from a single crystalline state to a polycrystalline state. It is considered that the growth of the crystals bringing about the light scattering and light transmission depends on the particle size of the organic low-molecular-weight material dispersed in the matrix resin. It is believed that the change of the crystalline states of the organic low-molecular-weight material between the single crystalline state and the polycrystalline state is caused by the mutual action between the organic low-molecular-weight material and the matrix resin. The mutual action between the matrix resin and the organic low-molecular-weight material varies depending on the particle size of the organic low-molecular-weight material, and therefore the condition of the transparent state and that of the milky white opaque state are subject to variation. Namely, when the average particle diameter of the dispersed organic low-molecular-weight material is too large, it is difficult for the organic low-molecular-weight material to assume a polycrystalline state, so that the light scattering effect is decreased. Thus, the whiteness degree in the milky white opaque state is lowered and the image contrast is degraded. When the average particle diameter of the organic low-molecular-weight material is too small, the formation of the polycrystalline state of the organic low-molecular-weight material in the matrix resin becomes difficult in the course of the crystal growth. In this case, the whiteness degree in the milky white opaque state is also lowered and the image contrast is degraded.

To improve the image contrast in reading the bar code formed in the reversible thermosensitive recording layer by a bar-code reader, it is preferable that the average particle diameter of the organic low-molecular-weight material be in the range of one eighth to 2 times the wavelength of a light source used to read the bar code. Although the reason has not been clarified, it is supposed that the whiteness degree in the milky white opaque state, in other words, the degree of the light scattering is determined by the size of crystals of the organic low-molecular-weight material, and the size of the crystals varies depending on the particle size of the organic low-molecular-weight material.

Depending on the area of the interface of the matrix resin and the organic low-molecular-weight material dispersed therein, which is determined by the particle size of the organic low-molecular-weight material, the degree of the mutual action between the matrix resin and the organic low-molecular-weight material varies, and further, the degree of the above-mentioned mutual action has an important effect upon the crystal size of the organic low-molecular-weight material.

In addition, each organic low-molecular-weight material has an optimal crystal size for scattering the light with a certain wavelength. This optimal crystal size varies depending on the kind of organic low-molecular-weight material. When the crystal size is smaller than the wavelength of the applied light, the light is easily scattered. As previously described, when the average particle diameter of the organic low-molecular-weight material is in the range of one eighth to 2 times the wavelength of the light for use in the bar-code reader, the size of each crystal of the organic low-molecular-weight material in the polycrystalline state is considered to be the most appropriate for scattering the light.

When the average particle diameter of the organic low-molecular-weight material is within the above range, the light scattering effect does not decrease and therefore high image contrast can be obtained. In addition to this, the decrease of the mutual action between the matrix resin and the organic low-molecular-weight material due to the decrease in area of the interface between the matrix resin and the organic low-molecular-weight material can be prevented, thereby facilitating the control of the crystal growth in the organic low-molecular-weight material. As a result, the whiteness degree in the milky white opaque state can be increased and the high image contrast can be obtained.

The particle diameter of the organic low-molecular-weight material can be controlled by using a bad solvent, controlling the drying conditions in the course of coating a coating liquid for the reversible thermosensitive recording layer 3, or adding a surface-active agent to the coating liquid for the recording layer 3 to adjust the dispersion properties. The method for controlling the particle diameter, however, is not limited to the above.

It is stipulated in JIS B 9550 that the wavelength of a light source for use in the bar-code reader be 600 nm or more, and the light source with a wavelength in the range of 600 to 1000 nm is commonly used in practical use.

Specifically, an LED with a wavelength of 660 nm or 940 nm; and laser such as He-Ne laser with a wavelength of 660 nm, and a semiconductor laser with a wavelength of 680, 780 or 960 nm are widely used for the bar-code reader.

When the reversible thermosensitive recording material is used as a bar code display medium as shown in FIG. 1(*g*), not only the light source with a wavelength of 600 nm or more, but also the light source with a wavelength shorter than mentioned above can be employed. It is rather preferable to use the light source with a shorter wavelength to obtain a high image contrast. For example, in the case where the light with a wavelength of 400 to 600 nm is used to read the above-mentioned bar code, the obtained image contrast is maximally 2 times that obtained by use of the light source with a wavelength of 600 to 1000 nm. It is considered that this is because the shorter the wavelength of the light, the larger the refractive index of the light with respect to the organic low-molecular-weight material. Therefore, the amount of the scattered light is increased, thereby improving the whiteness degree in the white opaque portion.

To form the reversible thermosensitive recording layer 3, (1) a solution in which both the matrix resin and the organic low-molecular-weight material are dissolved, or (2) a dispersion prepared by dispersing the finely-divided particles of the organic low-molecular-weight material in a matrix resin solution may be coated on the lower layer, and then dried. In the case where the above-mentioned dispersion (2) is used for the formation of the reversible thermosensitive recording layer 3, a solvent which does not dissolve at least one organic low-molecular-weight material therein is used for the matrix resin solution.

The solvent used in the coating liquid for the thermosensitive recording layer 3 can be selected depending on the kind of matrix resin and the type of organic low-molecular weight material to be employed. For example, solvents such as tetrahydrofuran, methyl ethyl ketone, methyl isobutyl ketone, chloroform, carbon tetrachloride, ethanol, toluene and benzene can be employed. Not only when the matrix resin dispersion (2) is used, but also when the matrix resin solution (1) is used, the organic low-molecular-weight material separates out in the form of finely-divided particles and is dispersed in the matrix resin in the reversible thermosensitive recording layer 3.

It is preferable to employ a matrix resin that can form a reversible thermosensitive recording layer in which finely-divided particles of the organic low-molecular-weight material are uniformly dispersed and that can impart high transparency to the recording layer when the recording layer is in a maximum transparent state. Therefore, it is preferable that the matrix resin have high transparency, mechanical stability and excellent film forming properties. Examples of such resins include polyvinyl chloride, vinyl chloride copolymers such as vinyl chloride—vinyl acetate copolymer, vinyl chloride—vinyl acetate—vinyl alcohol copolymer, vinyl chloride—vinyl acetate—maleic acid copolymer and vinyl chloride—vinyl acrylate copolymer; polyvinylidene chloride, vinylidene chloride copolymers such as vinylidene chloride—vinyl chloride copolymer, and vinylidene chloride—acrylonitrile copolymer; polyester; polyamide; polyacrylate, polymethacrylate and acrylate—methacrylate copolymer; and silicone resin. These resins can be used alone or in combination.

The organic low-molecular-weight material for use in the reversible thermosensitive recording layer 3 may appropriately be selected from the materials which are changeable from the polycrystalline state to the single crystalline state in accordance with each of the desired temperatures ranging from $T_0$ to $T_3$ as shown in FIG. 3. It is preferable that the organic low-molecular-weight material for use in the present invention have a melting point ranging from 30° to 200° C., more preferably from about 50° to 150° C.

Examples of the organic low-molecular-weight material for use in the present invention are alkanols; alkane diols; halogenated alkanols or halogenated alkane diols; alkylamines; alkanes; alkenes; alkynes; halogenated alkanes; halogenated alkenes; halogenated alkynes; cycloalkanes; cycloalkenes; cycloalkynes; saturated or unsaturated monocarboxylic acids, or saturated or unsaturated dicarboxylic acids, and esters, amides and ammonium salts thereof; saturated or unsaturated halogenated fatty acids and esters, amides and ammonium salts thereof; arylcarboxylic acids, and esters, amides and ammonium salts thereof; halogenated arylcarboxylic acids, and esters, amides and ammonium salts thereof; thioalcohols; thiocarboxylic acids, and esters, amides and ammonium salts thereof; and carboxylic acid esters of thioalcohol. These materials can be used alone or in combination.

It is preferable that the number of carbon atoms of the above-mentioned organic low-molecular-weight material be in the range of 10 to 60, more preferably in the range of 10 to 38, further preferably in the range of 10 to 30. Part of the alcohol groups in the esters may be saturated or unsaturated, and further may be substituted by a halogen. In any case, it is preferable that the organic low-molecular-weight material have at least one atom selected from the group consisting of oxygen, nitrogen, sulfur and a halogen in its molecule. More specifically, it is preferable the organic low-molecular-weight materials comprise, for instance, —OH, —COOH, —CONH, —COOR, —NH, —$NH_2$, —S—, —S—S—, —O— or a halogen atom.

Specific examples of the above-mentioned organic low-molecular-weight materials include higher fatty acids such as lauric acid, dodecanoic acid, myristic acid, pentadecanoic acid, palmitic acid, stearic acid, behenic acid, nonadecanoic acid, arachic acid, and oleic acid; esters of higher fatty acids such as methyl stearate, tetradecyl palmitate and dodecyl behenate; and the following ethers or thioethers:

$C_{16}H_{33}$—O—$C_{16}H_{33}$, $C_{16}H_{33}$—S—$C_{16}H_{33}$, $C_{18}H_{37}$—S—$C_{18}H_{37}$, $C_{12}H_{25}$—S—$C_{12}H_{25}$, $C_{19}H_{39}$—S—$C_{19}H_{39}$, $C_{12}H_{25}$—S—S—$C_{12}H_{25}$,

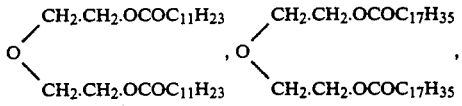

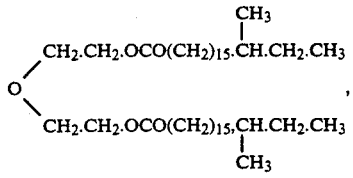

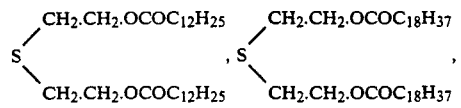

-continued

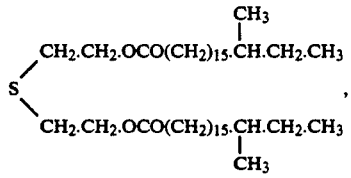

,

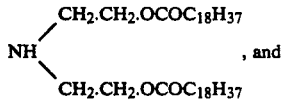

, and

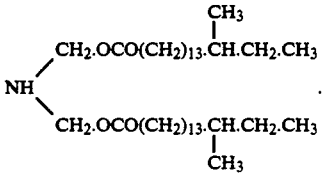

.

Of these, higher fatty acids having 16 or more carbon atoms, more preferably having 16 to 24 carbon atoms, such as palmitic acid, stearic acid, behenic acid and lignoceric acid are preferred in the present invention.

To extend the temperature range where the reversible thermosensitive recording layer 3 maintains the transparent state, the above-mentioned organic low-molecular-weight materials may appropriately be used in combination. Alternatively, the above-mentioned organic low-molecular-weight material may be used in combination with the other materials having a different melting point, as disclosed in Japanese Patent Applications 63-39378 and 63-130380, and Japanese Patent Publications 63-14754 and 1-140109.

It is preferable that the ratio by weight of the organic low-molecular-weight material to the matrix resin be in the range of about (2 : 1) to (1 : 16), more preferably in the range of (1 : 1) to (1 : 3). When the ratio of the organic low-molecular-weight material to the matrix resin is within the above range, the matrix resin can form a film in which the organic low-molecular-weight material is uniformly dispersed in the form of finely-divided particles, and the obtained recording layer can readily reach the maximum white opaque state.

In the reversible thermosensitive recording layer 3 for use in the present invention, additives such as a surface-active agent and a high-boiling point solvent can be employed to facilitate the formation of a transparent image.

Specific examples of the high-boiling point solvent are tributyl phosphate, tri-2-ethylhexyl phosphate, triphenyl phosphate, tricresyl phosphate, butyl oleate, dimethyl phthalate, diethyl phthalate, dibutyl phthalate, diheptyl phthalate, di-n-octyl phthalate, di-2-ethylhexyl phthalate, diisononyl phthalate, dioctyldecyl phthalate, diisodecyl phthalate, butylbenzyl phthalate, dibutyl adipate, di-n-hexyl adipate, di-2-ethylhexyl adipate, di-2-ethylhexyl azelate, dibutyl sebacate, di-2-ethylhexyl sebacate, diethylene glycol dibenzoate, triethylene glycol, di-2-ethyl butyrate, methyl acetylricinoleate, butyl acetylricinoleate, butylphthalyl butyl glycolate and tributyl acetylcitrate.

Specific examples of the surface-active agent are polyhydric alcohol higher fatty acid esters; polyhydric alcohol higher alkyl ethers; lower olefin oxide adducts of polyhydric alcohol higher fatty acid ester, higher alcohol, higher alkylphenol, higher alkylamine of higher fatty acid, amides of higher fatty acid, fat and oil and polypropylene glycol; acetylene glycol; sodium, calcium, barium and magnesium salts of higher alkyl benzenesulfonic acid; calcium, barium and magnesium salts of higher fatty acid, aromatic carboxylic acid, higher aliphatic sulfonic acid, aromatic sulfonic acid, sulfuric monoester, phosphoric monoester and phosphoric diester; lower sulfated oil; long-chain polyalkyl acrylate; acrylic oligomer; long-chain polyalkyl methacrylate; copolymer of long-chain alkyl methacrylate and amine-containing monomer; styrene—maleic anhydride copolymer; and olefin—maleic anhydride copolymer.

In the present invention, a protective layer may be formed on the reversible thermosensitive recording layer 3 to protect the thermosensitive recording layer 3. It is preferable that the protective layer have a thickness in the range of 0.1 to 5 μm. As the material for the protective layer, silicone rubber, silicone resin (described in Japanese Laid-Open Patent Application 63-221087), polysiloxane graft polymer (described in Japanese Laid-Open Patent Application 62-152550), ultraviolet-curing resin or electron-radiation-curing resin (described in Japanese Laid-Open Patent Application 63-310600) can be employed. In any case, the above-mentioned material for the protective layer is dissolved in a solvent to prepare a coating liquid, and the thus prepared coating liquid is coated on the thermosensitive recording layer 3. It is desirable that the matrix resin and the organic low-molecular-weight material for use in the thermosensitive recording layer 3 be not easily dissolved in such a solvent for use in the protective layer.

Preferable examples of the above-mentioned solvent for use in a coating liquid for the protective layer include n-hexane, methyl alcohol, ethyl alcohol and isopropyl alcohol. In particular, alcohol-based solvents are preferred from the viewpoint of cost.

Further, an intermediate layer may be interposed between the protective layer and the thermosensitive recording layer 3 to protect the thermosensitive recording layer 3 from the solvent or a monomer component for use in the coating liquid for the protective layer, as disclosed in Japanese Laid-Open Patent Application 1-133781.

Examples of the material for use in the coating liquid for the intermediate layer include the same resins as used for the matrix resin in the thermosensitive recording layer 3, and thermosetting resins and thermoplastic resins such as polyethylene, polypropylene, polystyrene, polyvinyl alcohol, polyvinyl butyral, polyurethane, saturated polyester, unsaturated polyester, epoxy resin, phenolic resin, polycarbonate, and polyamide.

It is preferable that the intermediate layer have a thickness of about 0.1 to 2 μm.

Other features of this invention will become apparent in the course of the following description of exemplary embodiments which are given for illustration of the invention and are not intended to be limiting thereof.

EXAMPLE 1

Formation of undercoat layer

A part of a white PET film "Lumirror X-20" (Trademark), made by Toray Industries, Inc., with a thickness of about 188 μm, was printed with a black UV ink, whereby a black colored portion was formed. Aluminum was deposited on the rest portion of the PET film, whereby a light reflecting portion with a glossiness of 700% was formed. Thus, an undercoat layer was provided on the support.

Formation of reversible thermosensitive recording layer

The following components were mixed to prepare a coating liquid for a reversible thermosensitive recording layer:

| | Parts by Weight |
|---|---|
| Behenic acid (Trademark: "NAA-22S", made by Nippon Oils & Fats Co., Ltd.) | 6 |
| Eicosanedioic acid (Trademark: "SL-20", made by Okamura Oil Mill Ltd.) | 4 |
| Diisodecyl phthalate | 3 |
| Vinyl chloride-vinyl acetate-phosphoric ester copolymer (Trademark: "Denka Vinyl #1000 p", made by Denki Kagaku Kogyo K.K.) | 25 |
| Tetrahydrofuran | 150 |
| Toluene | 15 |

The thus obtained coating liquid was coated on the undercoat layer by a wire bar and dried under application of heat thereto, whereby a reversible thermosensitive recording layer with a thickness of about 15 μm was provided on the undercoat layer.

Formation of intermediate layer

The following components were mixed to prepare a coating liquid for an intermediate layer:

| | Parts by Weight |
|---|---|
| Polyamide resin (Trademark: "CM8000", made by Toray Industries Inc.) | 10 |
| Methanol | 90 |

The thus obtained coating liquid was coated on the reversible thermosensitive recording layer by a wire bar and dried under application of heat thereto, whereby an intermediate layer with a thickness of about 1 μm was formed on the reversible thermosensitive recording layer.

Formation of protective layer

The following components were mixed to prepare a coating liquid for a protective layer:

| | Parts by Weight |
|---|---|
| 75% butyl acetate solution of urethaneacrylate-based ultraviolet-curing resin (Trademark: "Unidic C7-157", made by Dainippon Ink & Chemicals, Incorporated.) | 10 |
| Toluene | 10 |

The thus obtained coating liquid was coated on the intermediate layer by a wire bar, dried under application of heat thereto, and cured by the irradiation of an ultraviolet lamp of 80 W/cm to form a protective layer with a thickness of about 5 μm on the intermediate layer, so that a reversible thermosensitive recording material according to the present invention was obtained.

The thus obtained reversible thermosensitive recording material was heated to 80° C. to allow the reversible thermosensitive recording layer to assume a transparent state. With the application of heat to the recording material by a thermal head, numerals were recorded on the reversible thermosensitive recording layer corresponding to the black colored portion of the undercoat layer, while bar code images were recorded on the reversible thermosensitive recording layer corresponding to the aluminum-deposited portion (light reflecting portion) of the undercoat layer.

The numerals were legible when viewed from any angle. In addition, when the bar code images were read 10 times by a bar code scanner, accurate reading was carried out 10 times.

EXAMPLE 2

Formation of reversible thermosensitive recording layer

The following components were mixed to prepare a coating liquid for a reversible thermosensitive recording layer:

| | Parts by Weight |
|---|---|
| Behenic acid (Trademark: "NAA-22S", made by Nippon Oils & Fats Co., Ltd.) | 6 |
| Eicosanedioic acid (Trademark: "SL-20", made by Okamura Oil Mill Ltd.) | 4 |
| Diisodecyl phthalate | 3 |
| Vinyl chloride-vinyl acetate-phosphoric ester copolymer (Trademark: "Denka Vinyl #1000 p", made by Denki Kagaku Kogyo K.K.) | 25 |
| Tetrahydrofuran | 150 |
| Toluene | 15 |

The thus obtained coating liquid was coated by a wire bar on a transparent PET film with a thickness of about 50 μm "Lumirror T-60" (Trademark), made by Toray Industries, Inc., and dried under application of heat thereto, so that a reversible thermosensitive recording layer was formed on the transparent PET film.

Formation of intermediate layer

The following components were mixed to prepare a coating liquid for an intermediate layer:

| | Parts by Weight |
|---|---|
| Polyamide resin (Trademark: "CM8000", made by Toray Industries Inc.) | 10 |
| Methanol | 90 |

The thus obtained coating liquid was coated on the reversible thermosensitive recording layer by a wire bar and dried under application of heat thereto, whereby an intermediate layer with a thickness of about 1 μm was formed on the reversible thermosensitive recording layer.

Formation of protective layer

The following components were mixed to prepare a coating liquid for a protective layer:

| | Parts by Weight |
|---|---|
| 75% butyl acetate solution of urethaneacryl-based ultraviolet-curing resin (Trademark: "Unidic C7-157", made by Dainippon Ink & Chemicals, Incorporated.) | 10 |

-continued

| | Parts by Weight |
|---|---|
| Toluene | 10 |

The thus obtained coating liquid was coated on the intermediate layer by a wire bar, dried under application of heat thereto, and cured by the irradiation of an ultraviolet lamp of 80 W/cm to form a protective layer with a thickness of about 5 μm on the intermediate layer. Thus, a laminated material 1 was prepared.

Formation of undercoat layer

A part of a white PET film "Lumirror X-20" (Trademark), made by Toray Industries, Inc., with a thickness of about 188 μm was printed with a black UV ink, whereby a black colored portion was formed. Aluminum was deposited on the rest portion of the PET film, whereby a light reflecting portion with a glossiness of 700% was formed. Thus, an undercoat layer was formed on the support, so that a laminated material 2 was obtained.

With the transparent PET film of the laminated material 1 directed to the undercoat layer of the laminated material 2, the laminated materials 1 and 2 were laminated with an adhesive in such a fashion that only the periphery of the transparent PET film was attached to the undercoat layer to form an air-containing vacant portion therebetween. The air-containing vacant portion thus provided served as a low-refractive-index layer. Thus, a reversible thermosensitive recording material according to the present invention with the structure as shown in FIG. 1(*e*) was obtained.

On the above prepared reversible thermosensitive recording material of the present invention, numerals and bar code images were recorded by the same method as in Example 1.

The numerals were still more legible when viewed from any angle as compared with the case in Example 1.

In addition, when the bar code images were read 10 times by a bar-code scanner, accurate reading was carried out every time.

In the reversible thermosensitive recording material of the present invention, an undercoat layer comprising at least one colored portion and at least one light reflecting portion is provided on the back side of the reversible thermosensitive recording layer. Therefore, images formed in the recording material can be seen with the naked eyes without any problems, and at the same time, high image contrast can be obtained when measured by a measuring instrument.

What is claimed is:

1. A reversible thermosensitive recording material comprising a support, an undercoat layer formed on said support, and a reversible thermosensitive recording layer formed on said undercoat layer, capable of reversibly assuming a transparent state and a white opaque state depending on the temperature thereof, said undercoat layer comprising at least one colored portion and at least one light reflecting portion arranged side-by-side in the same layer of the undercoat layer or in superposed fashion in more than one layer of the undercoat layer to form a patterned image on said support.

2. The reversible thermosensitive recording material as claimed in claim 1, wherein said colored portion comprises at least two areas having different absorption bands.

3. The reversible thermosensitive recording material as claimed in claim 1, wherein said light reflecting portion comprises at least two areas having different reflectance.

4. The reversible thermosensitive recording material as claimed in claim 1, further comprising a low-refractive-index layer, which is provided between said undercoat layer and said reversible thermosensitive recording layer.

5. The reversible thermosensitive recording material as claimed in claim 4, further comprising a magnetic recording layer, which is provided on the back side of said support, opposite to said undercoat layer with respect to said support.

6. The reversible thermosensitive recording material as claimed in claim 4, wherein said low-refractive-index layer has a refractive index of 1.5 or less.

7. The reversible thermosensitive recording material as claimed in claim 1, further comprising a magnetic recording layer, which is provided on the back side of said support, opposite to said undercoat layer with respect to said support.

8. The reversible thermosensitive recording material as claimed in claim 1, wherein said light reflecting portion in said undercoat layer has a glossiness of 200% or more when measured at an angle of 60° in accordance with ASTM D523.

9. The reversible thermosensitive recording material as claimed in claim 1, wherein said reversible thermosensitive recording layer comprises a matrix resin and an organic low-molecular-weight material dispersed in said matrix resin.

10. The reversible thermosensitive recording material as claimed in claim 9, wherein the average particle diameter of said organic low-molecular-weight material is 0.1 to 2 μm.

* * * * *

UNITED STATES PATENT AND TRADEMARK OFFICE

CERTIFICATE OF CORRECTION

PATENT NO. : 5,278,128

DATED : January 11, 1994

INVENTOR(S) : Yoshihiko Hotta, et al

It is certified that error appears in the above-indentified patent and that said Letters Patent is hereby corrected as shown below:

Column 1, Line 23, "these according materials" should read --these recording materials--

Column 4, Line 42, "reversible thermo-sensitive" should read --reversible thermosensitive--

Column 9, Line 31, "carbon tetrachlorlde" should read --carbon tetrachloride--

Column 10, Line 43, "methyl stearate, tetradecyl palmitate" should read --methyl stearate, tetradecyl stearate, octadecyl stearate, octadecyl laurate, tetradecyl palmitate--

UNITED STATES PATENT AND TRADEMARK OFFICE

CERTIFICATE OF CORRECTION

PATENT NO. : 5,278,128

DATED : January 11, 1994

INVENTOR(S) : Yoshihiko Hotta, et al

It is certified that error appears in the above-indentified patent and that said Letters Patent is hereby corrected as shown below:

Column 10, Line 61, "$CH_2.CH_2.OCO(CH_2)_{15}.\underset{\underset{CH_3}{|}}{CH}.CH_2.CH_3$" should read

--$CH_2.CH_2.OCO(CH_2)_{15}.\underset{\underset{CH_3}{|}}{CH}.CH_2.CH_3$--

Signed and Sealed this

Tenth Day of January, 1995

*Attest:*

Bruce Lehman

BRUCE LEHMAN

*Attesting Officer*

*Commissioner of Patents and Trademarks*